US005788378A

United States Patent [19]

Thomas

[11] Patent Number: 5,788,378

[45] **Date of Patent: *Aug. 4, 1998**

[54] RECLOSABLE STAND-UP BAG

[75] Inventor: Toby R. Thomas, Pittsford, N.Y.

[73] Assignee: Tenneco Packaging Specialty and Consumer Products Inc., Lake Forest, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 722,471

[22] Filed: Sep. 27, 1996

[51] Int. Cl.[6] ..... B65D 33/25; B65D 30/18

[52] U.S. Cl. ..... 383/63; 383/64; 383/104; 383/120; 383/907; 383/124

[58] Field of Search ..... 383/63, 64, 65, 383/120, 61, 104, 210, 211, 906, 32, 36, 44, 78, 81, 82, 83, 84, 85, 86, 88, 107, 119, 122, 124, 125, 907

[56] References Cited

U.S. PATENT DOCUMENTS

| | | | |
|---|---|---|---|
| 2,358,653 | 9/1944 | Mock | 383/64 |
| 3,003,681 | 10/1961 | Orsini | 383/907 X |
| 3,367,380 | 2/1968 | Dickey | 383/906 X |
| 4,573,203 | 2/1986 | Peppiatt . | |
| 4,637,060 | 1/1987 | Ausnit . | |
| 4,713,839 | 12/1987 | Peppiatt . | |
| 4,736,450 | 4/1988 | Van Erden et al. | 383/120 X |
| 4,902,140 | 2/1990 | Branson | 383/63 X |
| 5,016,755 | 5/1991 | Kim | 383/907 X |
| 5,033,780 | 7/1991 | Wootten . | |
| 5,044,774 | 9/1991 | Bullard et al. . | |
| 5,113,555 | 5/1992 | Wilson et al. | 383/63 X |
| 5,174,658 | 12/1992 | Cook et al. . | |
| 5,211,482 | 5/1993 | Tilman | 383/64 X |
| 5,364,189 | 11/1994 | Kuge et al. | 383/64 X |
| 5,375,930 | 12/1994 | Tani . | |
| 5,417,040 | 5/1995 | Davoren . | |
| 5,529,394 | 6/1996 | Davoren . | |

FOREIGN PATENT DOCUMENTS

| | | | |
|---|---|---|---|
| 1090700 | 4/1955 | France | 383/65 |
| 1068102 | 10/1959 | Germany | 383/107 |
| 5097151 | 4/1993 | Japan | 383/61 |
| 5147663 | 6/1993 | Japan | 383/63 |
| 6127557 | 5/1994 | Japan | 383/89 |

*Primary Examiner*—Jes F. Pascua
*Attorney, Agent, or Firm*—Arnold, White & Durkee

[57] ABSTRACT

A reclosable standup bag and a method for manufacturing the bag. The bag includes opposing top and bottom panel assemblies. The top panel assembly includes first and second opposing fins having upper edge portions that define a mouth opening. Opposing front and back wall panels extend between the top and bottom panel assemblies. First and second opposing gusseted side wall panels couple and bridge the side edges of the front and back wall panels, defining four wall corners. A resealable closing assembly is coupled to the upper edge portion of the fins. The method for manufacturing the bag includes providing a lay flat web of a flexible packaging material and cutting comer reliefs at the location of the upper side corners of the bag. The lay flat web is run over a forming tube to create a duct-shaped cylinder with overlapping side edges. The side edges are joined and are fin sealed to form a tube having a bottom opening and a top opening. Side gussets are formed, centered about the die cut corner reliefs, leaving the two fins extending along either side of the corner reliefs and over the top opening of the tube. The side edges of each gusset and the bottom opening are sealed. The bottom portion of the tube is folded to form a generally flat bottom portion. A reclosable closing assembly is coupled to the upper edge portions of the first fin and the second fin.

11 Claims, 4 Drawing Sheets

RECLOSABLE STAND-UP BAG

BACKGROUND OF THE INVENTION

This invention relates to reclosable bags and, more particularly, to deformation-resistant, reclosable, stand-up and stand-alone storage bags for enclosing food products.

Reclosable bags typically include first and second opposing panels of a flexible material such as plastic film. For example, the first and second panels may be formed from a single sheet of film folded or wrapped upon itself. The sides of the opposing panels are fixedly connected to each other by heat sealing or by other means. The top edges of the panels define a mouth opening which permits access to the contents of the bag. A closing assembly is attached across the top edges of the bags to allow opening and closing of the mouth opening.

One type of closing assembly used in some reclosable plastic bags is a slider assembly operable to open a zipper extending along the mouth of the plastic bag. The zipper includes a male track having a male profile and an opposing female track having an engageable female profile. The male and female profiles are releasably engageable to each other. When the slider assembly is in a "closed" position, the male and female profiles of the zipper are interlocked along the entire length of the zipper. As the slider is moved to an "open" position, the male and female profiles disengage from each other, permitting access to the interior of the bag.

Reclosable bags like the one described above have been used to package food products. However, such reclosable bags lack stand-up structural integrity, i.e., sufficient rigidity and stability to remain in a generally undeformed vertical position, either when empty or when filled with a product. Conventional bags tend to deform or "sag" and assume a general bell shape when filled with product. Moreover, traditional reclosable bags do little to protect food products susceptible to crumbling or other damage during transport and handling.

Prior bags typically used in food product assembly line operations are generally manufactured in a vertically-oriented line, wherein gravity is used to feed product into a bag shortly after the bag assumes its basic shape with a single mouth opening. Then, a closing assembly is attached across the top edge of the bag, and the bag is subsequently sealed. However, most reclosable bag closing assemblies are horizontally-oriented, making them difficult to couple to the top edges of conventional bags manufactured in a vertical process in which the side edges of the bags are fully sealed prior to the coupling of the closing assembly. Thus, there remains a need for a reclosable bag or other container which is flexible, yet manages to retain its shape and general aesthetic appearance when filled with product. Such a bag preferably also would be relatively cost-efficient to manufacture.

SUMMARY OF THE INVENTION

The present invention is directed generally to a reclosable bag manufactured in a generally vertical production line. The bag is designed to have sufficient structural rigidity to stand upright when placed on its bottom surface and to resist effectively significant deformation of its shape, appearance or presentation when enclosing a food product. Bags in accordance with the present invention are suitable for stand-alone marketing or for placing inside of a rectangular box container, such as a cereal box.

The reclosable bag of the present invention comprises four wall panels: a front wall panel, a back wall panel, and two side wall panels. A bottom panel assembly is formed by joining the lower end portions of the four wall panels, with the side wall panels being gussetted, to form a generally box-shaped structure. The joined lower end portions may be sealed by heat sealing or other suitable methods known in the art. The gussetted side wall panels preferably are designed sufficiently rigid to permit the bag to stand upright with the bottom panel assembly contacting a support surface.

Preferably, during bag manufacture, fin sealing is used to join the edges of the bag film material that come together within the forming tube of the vertical production line. Moreover, the bag preferably is shaped so that the fin seal formed one of the wall corners. Remaining wall corners may be gusset sealed or may be made to hold a dead fold.

A top panel assembly, opposite the bottom panel assembly, comprises two "fins" or projections of the front and back panels which extend generally beyond the upper ends of the side wall panels. The side edges of both fins are sealed along at least a portion of their lengths to the upper edge portions of the corresponding side wall panels. The top panel assembly preferably further includes a zipper including a first track with a first profile and a second track with a second profile coupled to the upper edge portions of the first and second fins, respectively. A slider assembly is slideably mounted on the zipper, so that when the slider assembly is in a closed position, the first and second profiles engage each other along their entire lengths. As the slider assembly moves to an open position, the first and second profiles disengage from each other along at least a portion of their lengths.

The method for manufacturing the reclosable standup bag includes providing a lay flat web of a flexible packaging material. Comer reliefs are cut on the lay flat web. The comer reliefs are located at the top of the bag to be formed so as to define the shape of at least a portion of the upper edge of the side walls and the side edges of the fins. The lay flat web is run over a forming tube to create a duct of material with overlapping edges. A cross-section of the duct may be square, rectangular, circular, elliptical or any other generally closed shape depending upon the particular application involved. The overlapping edges are joined by fin sealing to form a tube having a bottom opening and a top opening. Side gussets preferably are formed centered about the comer reliefs, so that the two fins appear to extend beyond the top opening of the tube. Wall corners are formed and preferably either are sealed or are dead folded, again depending upon the requirements of the particular application involved. The bottom portion of the tube then is sealed and subsequently folded, so as to form the box-like structure comprising the bottom or lower portion of the bag.

To form the upper portion of the bag, the fins are sealed along a portion of the lengths of their sides to portions of the upper edges of the side panels. Then, a zipper or other closing assembly comprising first and second tracks is coupled to the upper edge portions of the first and second fins, respectively. The closing assembly preferably is operable to allow for releasable engagement of the first fin and the second fin. Finally, a slider assembly is placed along both the first and second tracks, and terminations comprising posts or other suitable fastening means couple the ends of the first and second tracks.

Examples of the more important features of this invention have been broadly outlined in order that the detailed description that follows may be better understood and so that contributions which this invention provides to the art may be better appreciated. There are, of course, additional features of the invention which will be described herein and which will be included within the subject matter of the claims appended hereto.

DETAILED DESCRIPTION OF THE INVENTION

Figure 1:
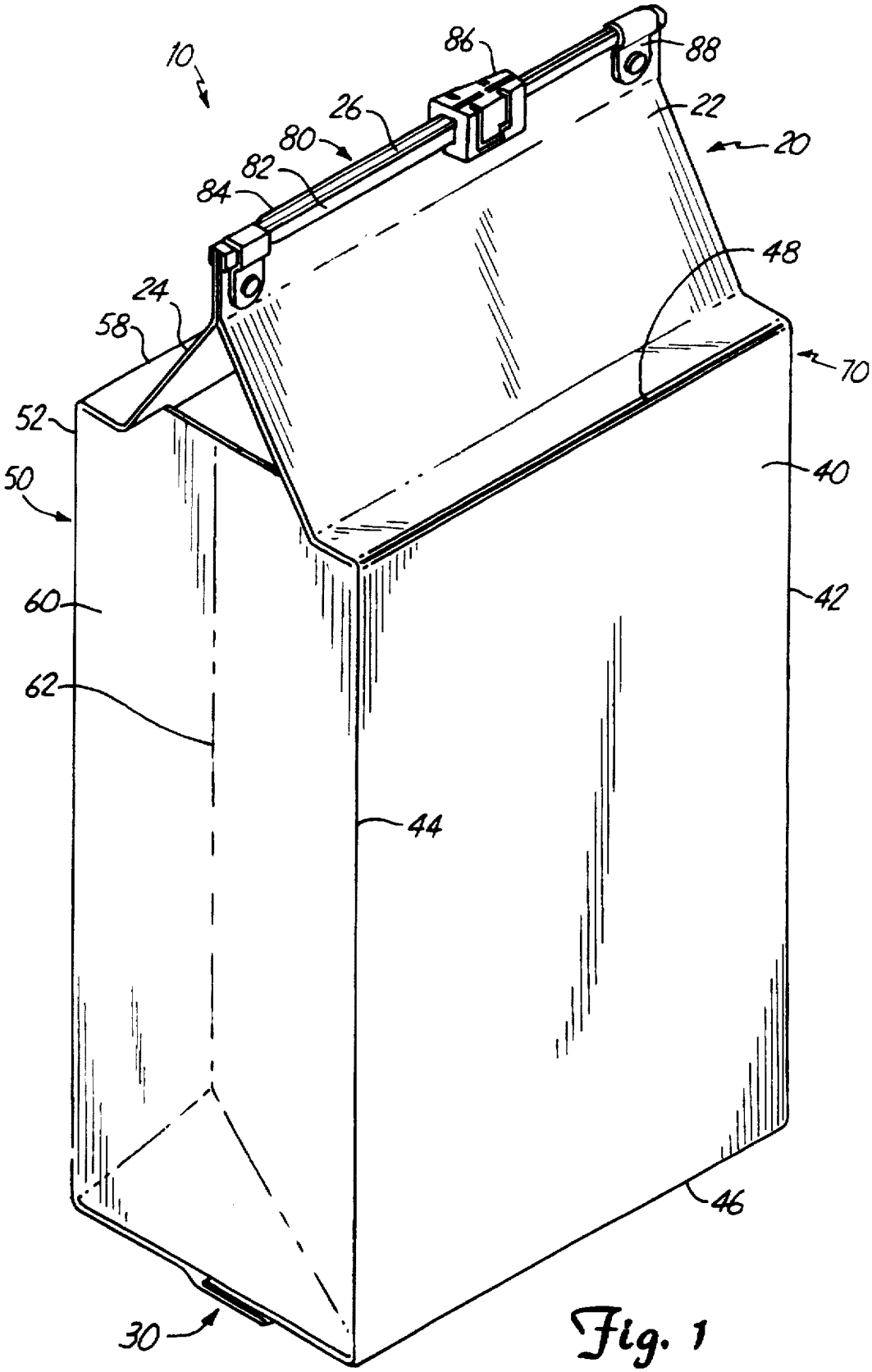
FIG. 1 is an isometric view of the top, front, and side of a reclosable standup bag in accordance with the present invention.

FIG. 1 illustrates a standup bag 10 in accordance with the present invention. The bag 10 includes a top panel assembly 20 and a bottom panel assembly 30, illustrated also in FIG. 2. Four wall panels—a front wall panel 40, a back wall panel 50, and two side wall panels 60 and 70—extend between the top panel assembly 20 and the bottom panel assembly 30 to form a generally box-shaped structure. The first and second opposing side walls 60 and 70 couple and bridge the front and back wall panels 40 and 50. As illustrated in the drawings, the wall panels of the bag 10 preferably are generally rectangularly shaped. The front and back wall panels 40 and 50 have side edges 42, 44 and 52, 54, and bottom and top edges 46, 48 and 56, 58 respectively. The side wall panels 60 and 70 are gusseted and are foldably connected to the front and back wall panels 40 and 50. The side wall panels bridge opposing side edges, 42 with 54 and 44 with 52, of the front and back wall panels to define four longitudinal corners for the bag 10. Longitudinal gusset seals or dead folds may be formed at each comer. Of course, a plurality of panels of different shapes and sizes, and thus a variety of different comer shapes and numbers may be used depending on the requirements of the particular applications involved.

The top panel assembly 20 includes a first fin 22 and a second fin 24. The fins 22 and 24 of bag 10 preferably are foldably connected to the top edges 48 and 58 of the front wall panel 40 and the back wall panel 50 respectively. The fins 22 and 24 couple over a top section of gusseted side wall panels 60 and 70. The fins 22 and 24 have top upper edge portions which define a mouth opening 26. See also FIG. 4.

A zipper 80 is placed on the mouth opening 26. The zipper 80 includes a first track 82 with a first profile and a second track 84 with a second profile. The first track 82 is attached to the upper edge portion of the first fin 22. The second track 84 is attached to the upper edge portion of the second fin 24. The first and second profiles of the tracks 82 and 84 are engageable to each other. See FIG. 7. A slider assembly 86 is mounted over both tracks 82 and 84. The slider assembly 86 can move along the length of tracks 82 and 84 to engage and disengage the tracks from each other. When the slider assembly 86 is in its closed position the first and second profiles of tracks 82 and 84 are engaged to each other to close completely mouth opening 26. When the slider assembly 86 is in an open position, at least a portion of the first and second profiles of tracks 82 and 84 are disengaged from each other. The slider assembly 86 also can be moved to an intermediate position along the length of tracks 84 and 82 to partially open or close mouth opening 26 and allow for easy pouring or access to the contents of bag 10.

To prevent the slider assembly 86 from going past the ends of the zipper 80 and to provide end strength to help resist stresses applied to the first and second profiles during normal use of the bag, end terminations in the form of posts 88 pass through the first and second tracks 82 and 84 at positions adjacent to the ends of the zipper 80. The posts 88 may be inserted through either the profiles or tracks of the zipper. To retain the posts 88 on the zipper 80, each of the posts 88 includes enlarged heads at its opposing ends. These enlarged heads may be formed by pressure, heat, or ultrasonic melt, or by other methods known in the art. In other embodiments, the zipper 80 can be replaced by other reclosable mechanisms, such as a peel seal, an adhesive seal, or a cohesive seal. Alternate embodiments may use clips, rivet, or other suitable termination devices.

Figure 2:
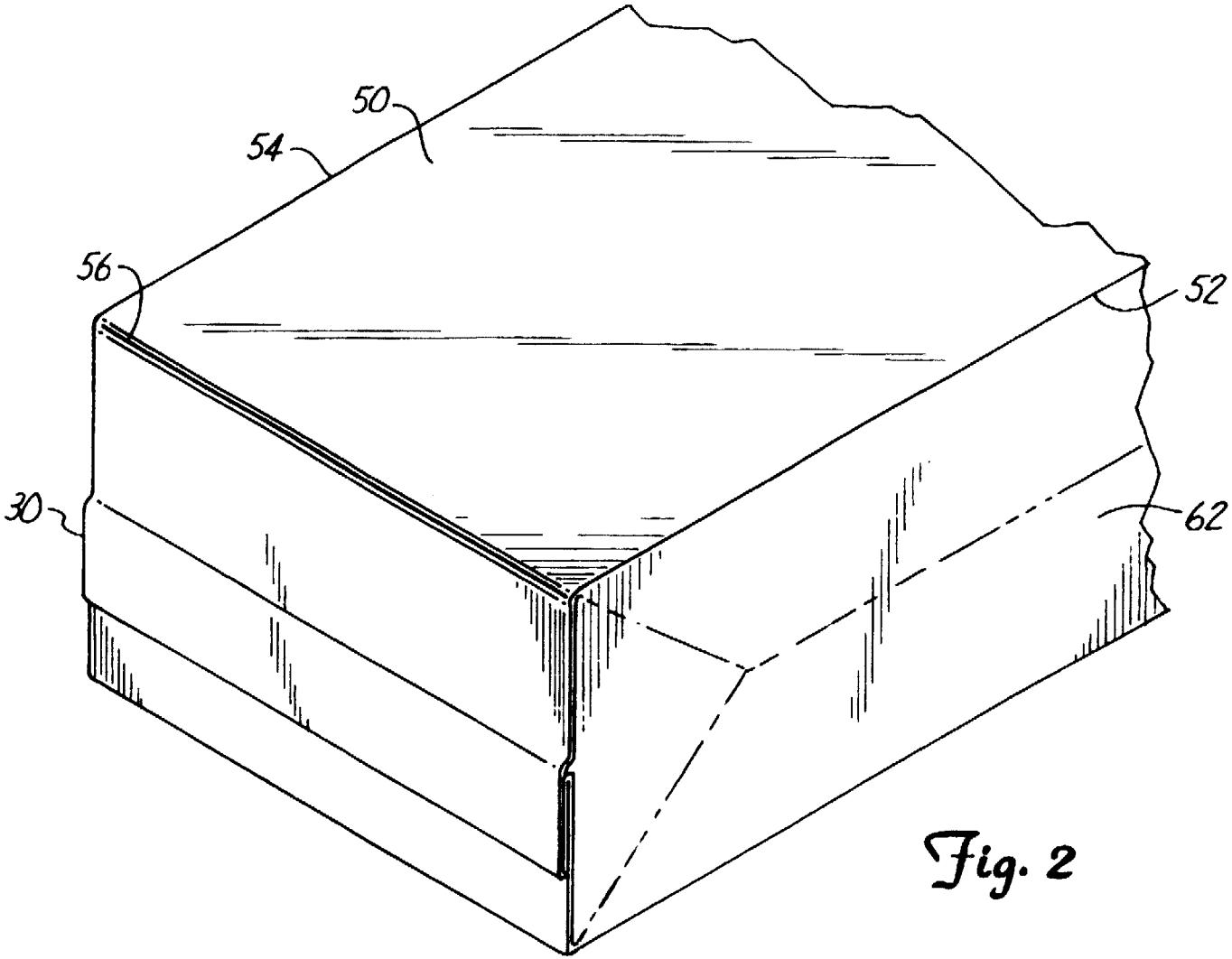
FIG. 2 is an isometric view of the bottom, back, and side of a portion of the standup bag illustrated in FIG. 1.
Figure 5:
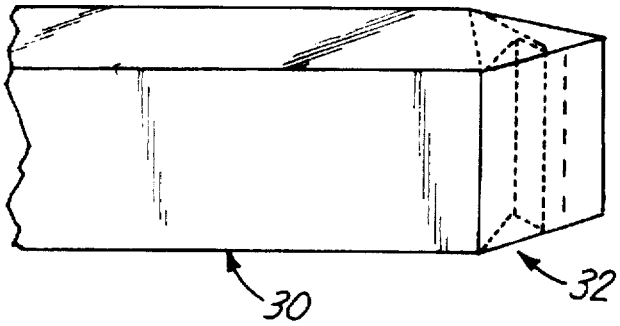
FIG. 5 is a perspective view of the front and side of a bottom portion of the bag of FIG. 1, including detail on the folding of the bottom panel assembly.

As illustrated in FIG. 2, the bottom panel assembly 30 of the bag 10 is foldably connected to the back wall panel 50 and, as shown in FIGS. 1 and 5, to the front wall panel 40. The bag bottom panel assembly 30 is formed by joining, such as by heat-sealing, lower end portions of the four wall panels, with the side wall panels being gussetted, to form the generally box-shaped structure.

The bag 10 is manufactured from a one piece lay flat web of flexible packaging material. The material used in the bag 10 is looped into a general tube shape having overlapping side edges. The bag includes a fin seal joining the side edges of the film material. The bag, once formed, is rigid enough to maintain a standup feature, and has the ability to hold a dead fold and/or to accept heat-seals. Gusset seals or fin seals, either alone or in combination, may give a bag the desired stand-up integrity. Other desirable characteristics for the film material include being of a food grade quality and having an ability to display printed graphics. The bag 10 is formed of polyethylene, polypropylene or other suitable materials known in the art. The bag of the present invention has sufficient stand-up integrity to remain in a generally undeformed vertical position when filled with a product, such that it does not tend to deform or to sag excessively.

Figure 3:
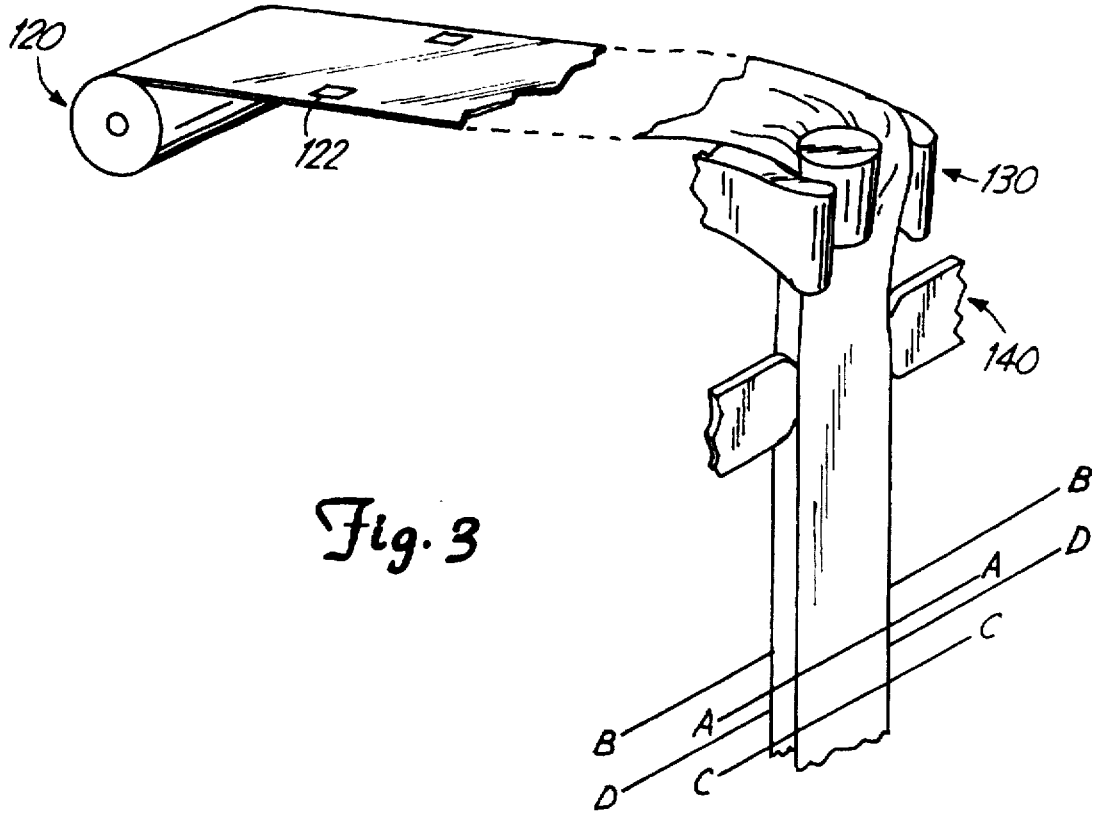
FIG. 3 is a simplified representation of steps in the manufacturing process of the bag of FIG. 1 in accordance with the present invention.

FIG. 3 illustrates steps in the manufacturing of the reclo-seable standup bag 10. First a lay flat web of a flexible packaging material is provided, such as in a roll stock 120. The web is unrolled and corner reliefs 122 are cut at positions corresponding to the top side corners of the bag. The corner reliefs 122 can be die-cut or can be manufactured by other methods known in the art. The size and the shape of the reliefs 122 will depend upon factors such as the desired size and shape of the closing fins, the width of the side wall panels, and the shape of the top closing side edges for the finished bag.

Figure 4:
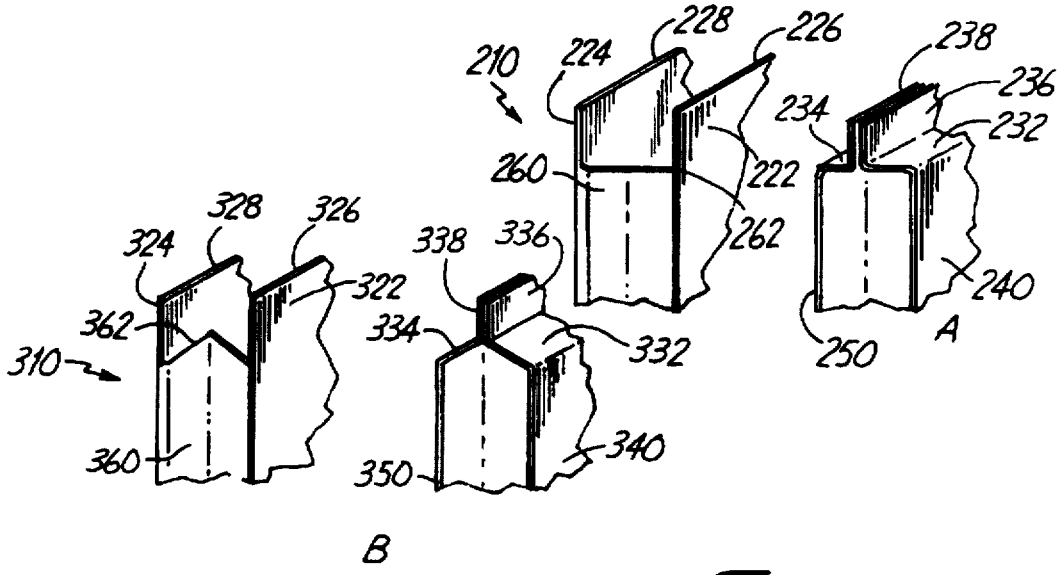
FIG. 4*a* is an isometric detail of a T-shaped top portion of a standup bag in accordance with the present invention.
FIG. 4*b* is an isometric detail of a Y-shaped second embodiment of a top portion of a standup bag in accordance with the present invention.

The use of comer reliefs allows for the creation of fins suitable for receiving a horizontally-oriented closing assembly. FIG. 4 illustrates two of the alternative closing profiles for a bag 210 and a bag 310. In bag 210, the comer reliefs are cut in a general square shape, yielding a generally "T"-shaped top side edge closing portion. As shown, the width of the corner reliefs determines the width of a gusseted side panel 260. The height of the comer relief also determines the height of two fins 222 and 224 of top panel assembly of bag 210. In bag 210, the generally square comer relief has defined a generally square shaped top end portion 262 for the side wall panel 260. A first portion 232 and 234 of fins 222 and 224 folds over the top portion 262 of side wall panel 260 at about a 90° angle. These first portions 232 and 234 may be sealed to the top portions of the side wall panels. A second interior portion 236 and 238 of fins 222 and 224 fold again to a position opposite each other in a negative 90° angle to form closure flaps for bag 210.

In the alternative embodiment of bag 310, a side wall panel 360 includes a top portion 362 shaped generally as a pointed wedge. The shape of this top portion 362 is again defined by the shape of the cut out relief formed during the manufacturing of the bag. Two fins 322 and 324 extend past the end of side wall panel 360 and are foldably connected to a front panel 340 and a back panel 350. A first portion 332 and 334 of fins 322 and 324 fold over the top portion 362 of side wall panel 360 and the corresponding (not shown) top portion of an opposing side wall panel. Second portions 336 and 338 of fins 322 and 324 fold to form the "Y"-shaped closing tabs of bag 310.

After the comer reliefs 122 are formed, the lay flat web of flexible packaging material is run over a forming tube 130, as illustrated in general outlines in FIG. 3. The forming tube 130 folds the web into a duct-shaped tube having joined side edges. The joined edges of the tube are fin sealed to each other.

Next, two gussets are formed centered about the comer reliefs or windows 122. Gusset boards 140 are used to form the gussets. Gusset edges can be gusset sealed by heat sealing or by other methods known in the art. The gusset seals and the fin seals preferably extend along the length of the wall corners to act as support beams and provide rigidity and stability to enhance the stand up integrity of the bag. Alternatively, the gusset edges may be made to hold a dead fold.

In the process illustrated in FIG. 3, two heat seal edges, illustrated by lines A—A and B—B, are forced together to create a bottom seal at a bottom portion of the bag. In the line manufacturing process illustrated in FIG. 3, the bottom seal is positioned just above the comer reliefs of a preceding bag.

The bag is filled with product or inflated with air. In the method illustrated in FIG. 3, the bag is manufactured in a vertically-oriented line and the product is dispensed by gravity. A shear, illustrated in FIG. 3 by lines C—C and D—D, separates a previously formed and filled bag from the roll stock 120. As described above, the specific cutout of the corner reliefs of the package defines the shape of the top panel assembly.

Figure 6:
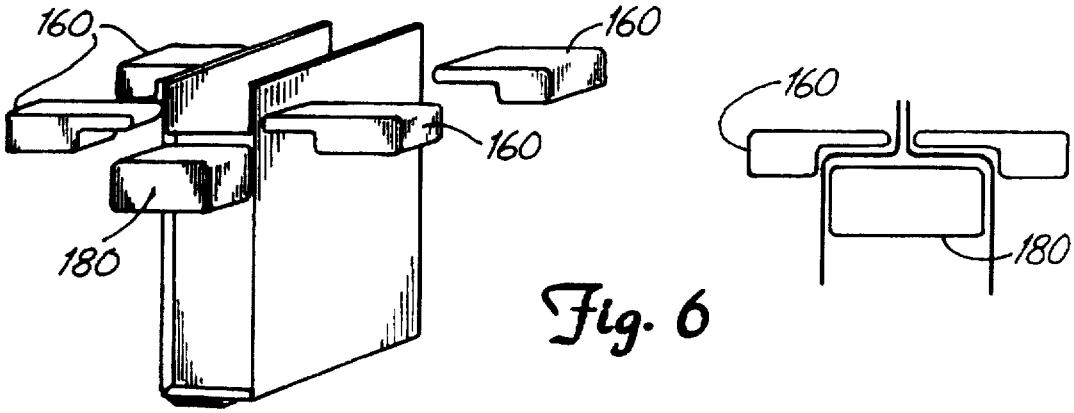
FIG. 6 is a simplified representation of steps in the manufacturing process of a bag in accordance with the present invention.
Figure 7:
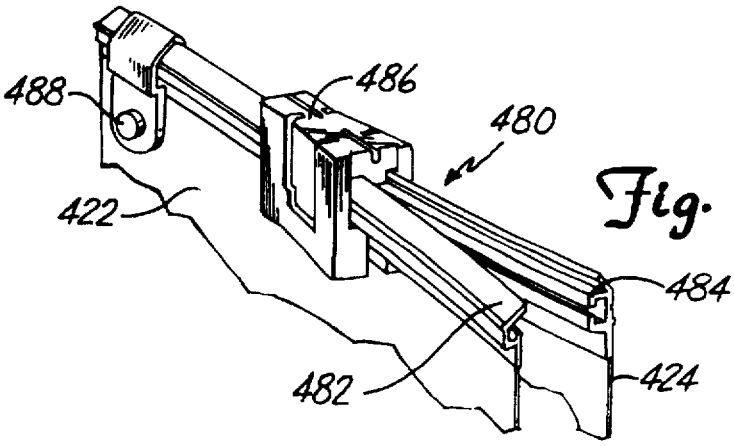
FIG. 7 is an isometric detail of a zipper and slider assembly for a bag in accordance with the present invention.

FIG. 5 illustrates the folding of a bottom portion 32 of the gussetted and sealed duct tube to form the bottom panel assembly 30 of bag IO. Adhesive, dead folds, heatsealing or other methods known in the art may be used to hold the folded bottom panel assembly. Top seals can be formed by heating and pressing seal forms 160 against mandrels 180 on either side of the bag, as illustrated in FIG. 6, or by other methods known in the art. The mandrels 180 fit between the gusset seals about the width of the gusset seal from the top of the cutouts. The seal forms 160 advance from both sides to form the top corner seals. The top seal can be formed in conjunction with the bottom seal prior to cut-off or shearing. Alternatively, the top seal can be completed in a post-filling operation. The zipper 480 is inserted, as illustrated in FIG. 7, between the top fins 422 and 424 of the bag, or, more specifically, between the top two closing tabs of the bag. The package may be gas flushed. The package is sealed to the zipper 480 with a tamperevident feature. The first track and the second track of the zipper are thermally fused to inner surfaces of the respective first and second fins. Alternatively, the zipper may be extruded with the fins, such that the first track is integrally formed with the first fin and the second track is integrally formed with the second fin. An ultrasonic welder or heat bar may be used to form the posts 488 that extend through the first and second tracks 482 and 484 and to preseal areas of the zipper 480. The zipper 480 and the posts 488 may be formed from any suitable plastic such as nylon, polypropylene, polystyrene, polyethylene, Delrin or ABS. In other embodiments, other resealable closing assemblies could be attached to the fins by methods such as adhesive application.

While the present invention has been described with reference to one or more particular embodiments, those skilled in the art will recognize that many changes can be made thereto without departing from the spirit and scope of the present invention. Each of these embodiments and obvious variations thereof is contemplated as falling within the spirit and scope of the claimed invention which is set forth in the following claims.

What is claimed is:

1. A reclosable bag, comprising:

opposing top and bottom panel assemblies, said top panel assembly including a first fin and a second opposing fin, the fins having upper edge portions defining a mouth opening;

opposing front and back wall panels extending between said top and bottom panel assemblies;

first and second opposing gusseted side wall panels, each side wall panel coupling to and bridging opposing side edges of the front and back wall panels, the coupling wall panels defining wall corners, said gusseted side wall panels being sufficiently rigid to permit the bag to stand upright with said bottom panel assembly contacting a support surface, said first fin being sealed to top portions of said first and second side wall panels, said second fin being sealed to top portions of said first and second side wall panels, the side wall panels including respective wedge-shaped top portions, at least a portion of the first and second fins of the top panel assembly being folded over and sealed to said wedge-shaped portions; and a reclosable closing assembly coupled to the upper edge portions of the first fin and the second fin, the closing assembly allowing for releasable engagement of the first fin and the second fin, said first and second fins being sufficiently wide relative to top portions of said side wall panels that each of said side wall panels are generally flat adjacent to said fins and the bag has a generally box-shaped structure when said first and second fins are engaged using said closing assembly, the closing assembly comprising a zipper including a first track with a first profile and a second track with a second profile, said first and second profiles being releasably engageable to each other, said first track being connected to said upper edge portion of said first fin and said second track being connected to said upper edge portion of said second fin.

2. The bag of claim 10, further including a slider assembly slidably mounted to said zipper for movement between a closed position and an open position, said first and second profiles being engaged to each other while said slider assembly is in said closed position, said first and second profiles being disengaged from each other in response to movement of said slider assembly from said closed position to said open position.

3. The bag of claim 10, wherein the bag comprises a one-piece film of a generally flexible material laterally looped into a tube having overlapping side edges and folded to form the front, back and side wall panels, the bag further comprising a longitudinal fin seal joining the overlapping side edges of said film of material.

4. The bag of claim 3, wherein the flexible material comprises polyethylene.

5. The bag of claim 4, wherein the fin seal is generally placed at one of the wall corners, the fin seal being sufficiently rigid to enhance the stand-up integrity of the bag.

6. The bag of claim 3, wherein the bottom panel assembly comprises a bottom portion of said tube folded in a generally flat arrangement and including a heat sealed edge coupling bottom edges of said tube.

7. The bag of claim 3, wherein the top panel assembly comprises a top portion of said tube.

8. The bag of claim 1, wherein the gusseted side wall panels further include one or more gusset seals located generally along at least one of the wall corners, the gusset seals being sufficiently rigid to permit the bag to stand upright with said bottom panel assembly contacting the support surface.

9. A reclosable bag, comprising:

opposing top and bottom panel assemblies, said top panel assembly including a first fin and a second opposing fin, the fins having upper edge portions defining a mouth opening;

opposing front and back wall panels extending between said top and bottom panel assemblies;

first and second opposing gusseted side wall panels each side wall panel coupling to and bridging opposing side edges of the front and back wall panels, the coupling wall panels defining wall corners, said gusseted side wall panels being sufficiently rigid to permit the bag to stand upright with said bottom panel assembly contacting a support surface, said first fin being sealed to top portions of said first and second side wall panels, said second fin being sealed to top portions of said first and second side wall panels, the side wall panels including a generally square portion located at a top end, the first and second fins of the top panel assembly being folded over and sealed to the square portion; and a reclosable closing assembly coupled to the upper edge portions of the first fin and the second fin, the closing assembly allowing for releasable engagement of the first fin and the second fin, said first and second fins being sufficiently wide relative to top portions of said side wall panels that each of said side wall panels are generally flat adjacent to said fins and the bag has a generally box-shaped structure when said first and second fins are engaged using said closing assembly, the closing assembly comprising a zipper including a first track with a first profile and a second track with a second profile, said first and second profiles being releasably engageable to each other, said first track being connected to said upper edge portion of said first fin and said second track being connected to said upper edge portion of said second fin.

10. A reclosable bag, comprising:

opposing top and bottom panel assemblies, said top panel assembly including a first fin and a second opposing fin, said first and second fins having respective upper edge portions defining a mouth opening, said first fin having a first pair of opposing end edges generally perpendicular to said upper edge portion of said first fin, said second fin having a second pair of opposing end edges generally perpendicular to said upper edge portion of said second fin;

opposing front and back wall panels extending between said top and bottom panel assemblies, said first fin and said first pair of opposing end edges extending upwardly from said front wall panel, said second fin and said second pair of opposing end edges extending upwardly from said back wall panel;

first and second opposing gusseted side wall panels, each side wall panel coupling to and bridging opposing side edges of the front and back wall panels, the coupling wall panels defining wall corners, said gusseted side wall panels being sufficiently rigid to permit the bag to stand upright with said bottom panel assembly contacting a support surface, said first pair of opposing end edges of said first fin being directly sealed to top edges of said respective first and second side wall panels, said second pair of opposing end edges of said second fin being directly sealed to top edges of said respective first and second side wall panels; and a reclosable closing assembly coupled to the upper edge portions of the first fin and the second fin, the closing assembly allowing for releasable engagement of the first fin and the second fin.

11. A reclosable bag, comprising:

opposing top and bottom panel assemblies, said top panel assembly including a first fin and a second opposing fin, said first and second fins having respective upper edge portions defining a mouth opening, said first fin having a first pair of opposing end edges non-parallel to said upper edge portion of said first fin, said second fin having a second pair of opposing end edges non-parallel to said upper edge portion of said second fin;

opposing front and back wall panels extending between said top and bottom panel assemblies, said first fin and said first pair of opposing end edges extending upwardly from said front wall panel, said second fin and said second pair of opposing end edges extending upwardly from said back wall panel;

first and second opposing gusseted side wall panels, each side wall panel coupling to and bridging opposing side edges of the front and back wall panels, the coupling wall panels defining wall corners, said gusseted side wall panels being sufficiently rigid to permit the bag to stand upright with said bottom panel assembly contacting a support surface, said first pair of opposing end edges of said first fin being directly sealed to top edges of said respective first and second side wall panels, said second pair of opposing end edges of said second fin being directly sealed to top edges of said respective first and second side wall panels; and a reclosable closing assembly coupled to the upper edge portions of the first fin and the second fin, the closing assembly allowing for releasable engagement of the first fin and the second fin.

* * * * *